US008378820B2

(12) United States Patent
Micko

(10) Patent No.: US 8,378,820 B2
(45) Date of Patent: Feb. 19, 2013

(54) INFRARED MOTION SENSOR SYSTEM AND METHOD

(75) Inventor: Eric Scott Micko, Rescue, CA (US)

(73) Assignee: Suren Systems, Ltd., Hong Kong (HK)

( * ) Notice: Subject to any disclaimer, the term of this patent is extended or adjusted under 35 U.S.C. 154(b) by 377 days.

(21) Appl. No.: 12/832,688

(22) Filed: Jul. 8, 2010

(65) Prior Publication Data

US 2011/0006897 A1 Jan. 13, 2011

Related U.S. Application Data

(60) Provisional application No. 61/270,482, filed on Jul. 10, 2009.

(51) Int. Cl.
*G08B 13/00* (2006.01)

(52) U.S. Cl. ..... 340/565; 340/573.1; 340/545.3

(58) Field of Classification Search ..... 340/565, 340/567, 568.1, 561, 552, 571, 572.1, 573.1, 340/600, 545.3, 545.4, 551, 541
See application file for complete search history.

(56) References Cited

U.S. PATENT DOCUMENTS 4,081,830 A 3/1978 Mick et al.
6,007,020 A * 12/1999 Gauggel et al. ..... 244/3.16
7,985,953 B2 * 7/2011 Luterotti et al. ..... 250/339.02
2005/0156758 A1 * 7/2005 Gilliss ..... 340/932.2
2005/0236572 A1 * 10/2005 Micko ..... 250/342
2005/0244047 A1 11/2005 Kern et al.
2008/0122926 A1 * 5/2008 Zhou et al. ..... 348/143
2008/0157964 A1 * 7/2008 Eskildsen et al. ..... 340/545.1

FOREIGN PATENT DOCUMENTS

WO 2005020815 3/2005

OTHER PUBLICATIONS

Notification, International Search Report and Written Opinion dated Feb. 14, 2011 for PCT/US2010/041409.

* cited by examiner

*Primary Examiner* — Daniel Previl
(74) *Attorney, Agent, or Firm* — Stephen C. Beuerle; Procopio Cory Hargreaves & Savitch LLP

(57) ABSTRACT

An infrared motion sensor system has an infrared (IR) sensor having a predetermined field of view, a target positioned within the field of view of the sensor which emits a spatially or temporally non-uniform pattern of IR radiation, and a processor which receives an output signal from the IR sensor, compares the received output signal to a signature temperature profile signal corresponding to the non-uniform pattern of IR radiation emitted by the target, and detects deviation of the sensor output signal from the signature temperature profile signal, indicating intervention of an object in a monitored volume between the target and sensor. The size of the target may be of the order of human size.

40 Claims, 5 Drawing Sheets

INFRARED MOTION SENSOR SYSTEM AND METHOD

RELATED APPLICATION

The present application claims the benefit of U.S. provisional pat. App. Ser. No. 61/270,482, filed Jul. 10, 2009, the contents of which are incorporated herein by reference in their entirety.

BACKGROUND

1. Field of the Invention

The present invention relates generally to passive infrared (PIR) motion sensors, and is particularly concerned with a PIR motion sensor system and method which includes a target.

2. Related Art

Passive infrared motion sensors generally consist of several features. An optical element (such as a lens or mirror) and an infrared (IR) detector together define and collect radiation from a field-of-view (intersecting and thus defining a monitored spatial volume), from which the optical element conveys radiation onto an infrared (IR) detector which is generally responsive to mid-IR light in the 6-14 micron wavelength range. The detector, in turn, provides an electrical signal responsive to changes in the effective blackbody temperature of the surfaces of objects within the monitored volume and radiating toward the optical element, which signal is passed to analog processing circuits, which, in turn, create a digital signal that may be directly or indirectly compared to a certain threshold amount of temperature change "seen" by the optical element from within the monitored volume. The digital signal may be further processed by logic circuits in order to provide a desired output indication, for example, of a warmer human crossing in front of cooler objects or background within a monitored volume.

One type of prior art infrared motion sensor system is illustrated in FIG. 1 and comprises an active-beam sensor system in which a pulsed, near-infrared (NIR) light beam is transmitted from transmitter 10 to receiver 12. Each transmitter has an emitter 15 and a lens 16 for directing the NIR light beam towards the receiver. Each receiver has a lens 17 and a detector 18 for receiving light directed by the lens onto the detector. A processor associated with the detector is configured to confirm NIR light transmission through the monitored volume 14 between transmitter 10 and receiver 12. The volume is typically a cylinder of 3 to 10 cm. diameter. Transmission interruption indicates objects moving within the monitored volume. Such active-beam sensors are commonly employed to monitor a facility's perimeter, by installing multiple transmitter/receiver linear segments in different directions so as to form a complete "fence" around the facility. The monitored volume in such systems is much less than human size so that the detector may be triggered by moving objects much smaller than humans.

Another known type of infrared motion sensor is a conventional long-range passive infrared (FIR) sensor 20 as illustrated in FIG. 2. This type of sensor monitors long and narrow static volumes 22, as indicated in FIG. 2, and has an infrared detector 24 and an optical element such as lens 25 which conveys radiation received from the monitored volume onto the detector. Such sensors are often employed to monitor a facility's perimeter by installing multiple PIR sensors whose monitored volumes form linear segments in different directions, so as to form a complete "fence" around the facility. One problem with this type of system is that the detection range cannot be controlled accurately, and will vary widely in response to different temperature, air clarity and other conditions which affect the detected temperature difference between a detected moving body and the background.

SUMMARY

Embodiments described herein provide a new defined target infrared motion sensor system and method.

In one embodiment, an infrared motion sensor system comprises an infrared (IR) sensor having a predetermined field of view, a target positioned within the field of view of the sensor which emits a non-uniform pattern of IR radiation, and a processor which receives an output signal from the IR sensor, compares the received output signal to a target signature signal or temperature profile corresponding to the non-uniform pattern of IR radiation emitted by the target, and detects deviation of the sensor output signal from the target signature signal indicating intervention of an object in a monitored volume between the target and sensor.

The target may be a passive, spatially non-uniform IR emitting target or an active, temporally non-uniform IR emitting target. In each embodiment, a certain signature spatial or temporal non-uniform pattern of IR radiation is emitted from the target. The processor associated with the IR sensor is arranged to continually check the signal temperature profile output by the sensor against previous profiles corresponding to the previously acquired target signature profile, in order to verify the continued and undisturbed presence of the target, or to detect the introduction of an object intervening between the target and the sensor. A spatially non-uniform target may be a target which has materials of different IR emissivities in different target sections, or different target sections which are heated or cooled relative to other sections. A temporally non-uniform emission target may be a varying emitter formed by a rod with an oscillating temperature or a rod at constant temperature which has an IR emission alternately blocked and un-blocked or "chopped" by an occluder of different temperature within the sensor-target axis.

The sensor may be a sensor with a static monitored volume or a scanning sensor with a moving monitored volume, for example with an optical system which moves relative to the sensor so that the field of view of the sensor scans across a monitored area.

In one embodiment, a facility's perimeter can be monitored by installing multiple units (in this case, sensor/target pairs) whose monitored volumes form linear segments in different directions so as to form a complete "fence" around the facility.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a PIR motion sensor system in which a PIR motion sensor has a remote target to enhance sensor function by defining a monitored volume comprising the portion of the sensor's field of view which can "see" the target. The target is defined by having a varying IR radiation emitting intensity over time and/or space, producing a signature temperature profile output from the sensor.

After reading this description, it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention.

Figure 3:
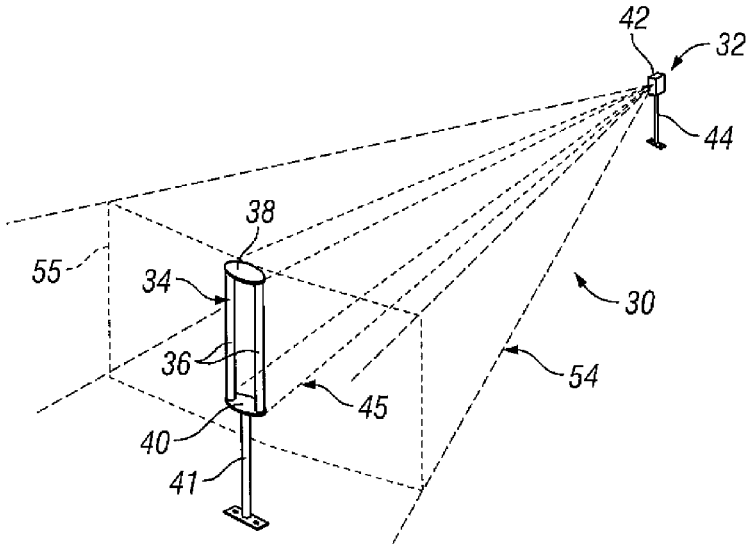
FIG. 3 is a schematic perspective view of a sensor/target pair in a defined target infrared (IR) motion sensor system according to a first embodiment.
Figure 4:
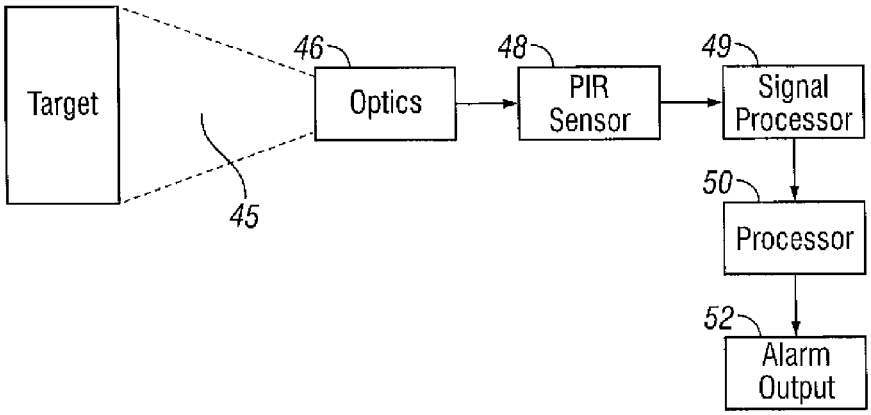
FIG. 4 is a block diagram of the system architecture of the system of FIG. 3.

FIGS. 3 and 4 illustrate a first embodiment of a defined target IR motion sensor system which includes one or more sensor-target pairs. FIG. 3 illustrates a single defined target/sensor pair 30 comprising a passive infrared (PIR) sensor 32 and a defined target 34 located at a defined distance from the PIR sensor. The sensor 32 may comprise any type of PIR sensor, such as a pyroelectric sensor. In one embodiment, the target/sensor pair or unit 30 of FIG. 3 comprises one segment of a system set up to monitor a facility's perimeter, with identical target/sensor pairs arranged at spaced intervals surrounding the facility, so as to form a complete "fence" around the facility. Alternatively, one or more such pairs may be arranged to monitor an indoor area.

Target 34 of FIG. 3 is a spatially non-uniform target or emitter which is vertically oriented in the illustrated embodiment, although the target may be horizontal or at other angular orientations in alternative embodiments. The target comprises two spaced vertically oriented rods 36 of materials having different emissivities which are secured between end brackets 38 and 40, with the entire unit supported on top of a vertical support post 41. End brackets 36 may also be of materials having different emissivities to form part of the signature target signal. The PIR sensor 32 is incorporated in a sensor unit 42 also supported on top of a vertical support post 44 at a similar height to the target rods 36 of target 34. Due to the different materials of different emissivity, the target emits a characteristic non-uniform pattern of IR radiation or signature IR profile which is detected by the sensor in each scan unless there is an intervening object between the sensor and target.

Unit 42 comprises an outer housing which contains a system as illustrated in FIG. 4 for detecting incoming IR signals and processing the signals to identify motion within a monitored area 45. As illustrated in FIG. 4, the sensor unit comprises sensor optics 46, a PIR sensor device 48, output signal processing electronics 49, a processor 50 such as a computer or application specific integrated circuit, and an alarm output 52. The processor may be located remote from the sensor unit in alternative embodiments and may receive the signal output of sensor device 48 via wireless communication.

In one embodiment, the system also includes a drive device (not illustrated) which moves the optical system relative to the sensor so that the field of view of the sensor repeatedly scans across a monitored volume. The sensor optics may include appropriate mirrors, lenses, and other components known in the art for focusing incoming IR radiation onto a PIR sensor device. The PIR sensor device generates an output signal that is filtered, amplified, and digitized by signal processing electronics 49 to produce a sensor output signal temperature profile each time the monitored area is scanned. Processor 50 receives the signal and determines whether to activate an audible or visual alarm 52 or other output device such as an activation system for a door, audible or visual alarm, notification to security personnel, or the like. The logic may be implemented on a computer readable medium associated with the processor. The computer readable medium may be logic circuits, solid state computer memory, disk-based storage, tape-based storage, or other appropriate computer medium.

Figure 1:
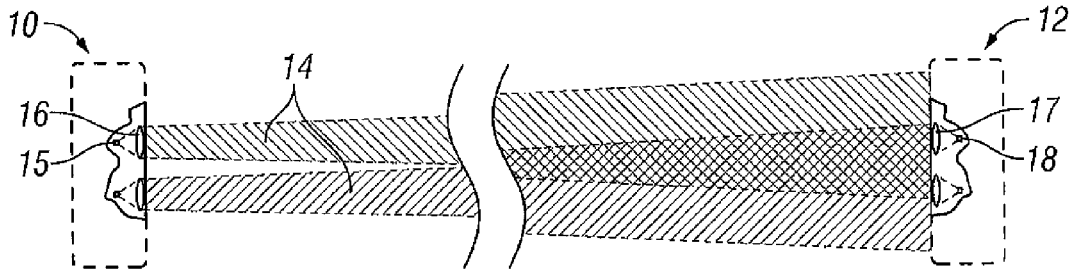
FIG. 1 (Prior Art)
FIG. 1 is a side elevation view of a prior art active beam motion sensor arrangement.
Figure 2:
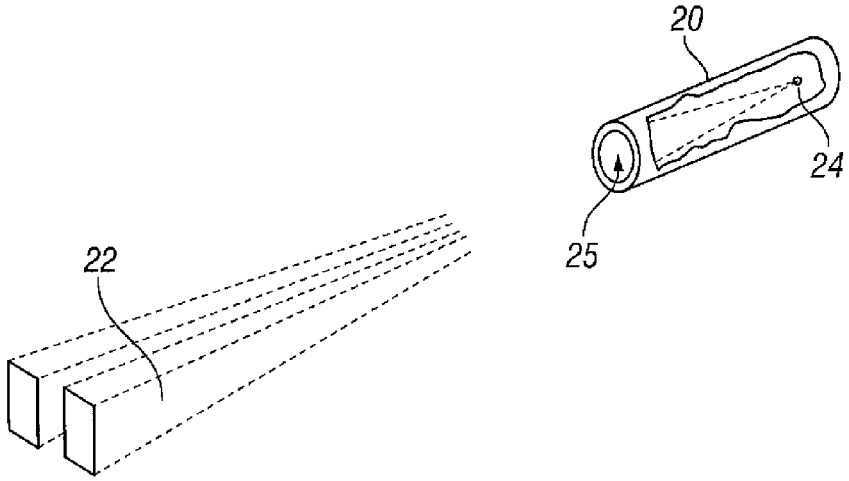
FIG. 2 (Prior Art)
FIG. 2 is partially broken away perspective view of a prior art passive infrared (PIR) sensor.

The sensor unit 42 receives IR radiation from the target 34 which is on the order of human-size or larger, which highlights an important difference between the invention and the prior art active-beam sensor of FIG. 1. In the embodiment of FIG. 3, sensor 32 is a scanning sensor with a moving monitored volume, as described below, but it may be a static or continuous sensor with a static monitored volume in alternative embodiments. The target occupies a significant solid angle within the sensor's overall field-of-view or scanned volume 54. When the target is rectangular in shape, as illustrated in the embodiment of FIG. 3, the sensor's monitored volume 45 is pyramid-shaped, compared to the active-beam sensor's narrow cylindrical beam-shaped monitored volume in the prior art system of FIG. 1. This allows the system to glean much more information about sensor/target conditions than prior art systems, as discussed in more detail below. Furthermore, in contrast with the prior art PIR sensor 24 of FIG. 2, a defined-target system's detection range is controlled to the distance d between the target and the sensor, whereas the detection range of the PIR sensor of FIG. 2 cannot be controlled accurately, and varies widely in response to different conditions of temperature, air clarity, and so forth, which affect the "seen" temperature difference between moving human and background.

As illustrated in FIG. 3, the target 34 occupies a significant portion of the cross-sectional area 55 of the scanned volume 54 at distance d from the PIR sensor (where d is the distance between the target and sensor). The target differs from prior art in which a sensor or receiver monitors a volume traversed by radiation from a small beam or from a point source, as in FIG. 1. In prior art active beam sensor systems, the beam or source is small compared to the object to be detected. In contrast, in the embodiment of FIG. 3, the single target may be of a similar order of size to the target to be detected, for example human size or larger. Although a single target is used in the embodiment of FIG. 3, enhanced systems may have multiple targets.

This embodiment provides a PIR sensor with moving monitored volumes (scanning), which create an overall monitored volume 54 consisting of all volumes monitored at one time or another by the scanning monitored volumes, and it also provides a "target" comprising an object (or objects) of non-uniform IR emission or temperature profile that is located within the overall monitored volume, so that the sensor, via its scanning monitored volume, "sees" varying IR emission over time, according to the size of the scanning monitored volume and its intersection versus time with the target's non-uniform IR emission profile. Though use of a vertical target supports many common applications, horizontal targets and targets at other angles may be used in alternative embodiments. The vertical target is particularly useful for a "fence" type of application for perimeter monitoring, as described below.

As the scanning sensor's monitored volume sweeps across the target, the sensor "sees" varying IR emission over time, as described above, and generates a "signature" output temperature profile corresponding to the target's emission profile. Usually, the signature sensor output temperature profile remains constant with every scan, or very slowly changing over periods of minutes (due to varying target conditions). The processor 50 of FIG. 4 saves the target "signature" sensor output temperature profile as a reference. Detection by processor 50 of a quicker signal change or a variation from the signature sensor output temperature profile indicates that an intervening object has blocked the sensor's view of the target by occupying the volume 45 defined by the intersection of the target with the sensor's overall monitored volume. This results in activation of a predetermined alarm output, such as an audible or visual alarm or notification of security personnel. Signals temporally corresponding to non-target-occupied portions of the overall monitored volume (i.e. parts of the sensor monitored volume 54 outside the pyramid-shaped target-to-sensor volume 45) do not comprise part of the target "signature", and thus are ignored by the sensor. Thus, the target-to-sensor volume 45 functions just as a "beam" between the target and scanning sensor, allowing this sensor to emulate an active-beam sensor's function, by detecting objects (e.g. human intruders) crossing the "beam". Because it only detects changes occurring between sensor and target, this system advantageously provides a controlled detection range, which is an improvement over the prior art, conventional PIR sensor of FIG. 2.

Because much of the monitored volume in the embodiment of FIGS. 3 and 4 is on the order of human size (as compared with the small cylindrical monitored area in the active-beam sensor prior art of FIG. 1), partial-blockage situations are possible, in which the sensor output signal may be used to estimate the blocking object's size. Such systems may be set up so that the monitored spatial volume of interest includes only the wider portions of the "beam" between target and sensor.

The target 34 of FIG. 3 may be modified by providing sections of the rods 36 or end brackets 38, 40 which are heated or cooled via a suitable powered heating or cooling arrangement. This may be used to increase the emission contrast between the different emissivity sections. For example, one of the rods 36 may be heated while the other is cooled for more IR emission contrast, or multiple alternating heated and cooled sections may be provided along the rods. This can provide a more vivid standard or signature target signal for better recognition in adverse weather conditions such as fog, rain or snow. Alternative targets of different shape and configurations may be used, such as multiple rods, blocks, or the like.

There are several possible methods of using the system of FIGS. 3 and 4, which may all be used by suitable programming of processor 50. In one method, the processor detects objects or persons coming between the sensor and the target by detection of rapid variation from the signature sensor output temperature profile, and sends a "detection" signal. The processor can confirm the continued presence of objects or persons remaining between the sensor and the target by continued variation from the signature sensor output temperature profile. The processor may also detect alterations in the target itself, also indicated by a change in the signature sensor output temperature profile. In an intruder-detection security system, such an alteration could be due to target sabotage, or due to an attempt to place a decoy target between the sensor and its usual target.

In an object-protection system, the target can be defined as the protected object (or objects). Upon detecting a target profile change, potentially because of a missing object, the processor can send a "detection" or alarm signal, which may indicate movement of an unauthorized individual in the monitored area or removal of the protected object. In another embodiment, the sensor may be set up to define an entire room (or parts of a room having one or more discrete "sub-targets" within) as its overall target. In this case, the room does not have to have a precisely designed emission variation characteristic, but the sensor can be designed to sweep the entire room and the processor is programmed to obtain and store a signature sensor output signal or temperature profile representing the IR emission profile of the room. This signature profile is "seen" with each scan, unless a person is moving in front of the normally scanned background. According to the mode of usage, a change in the signature scanned sensor output temperature profile of the room can indicate an intruder, sabotage, object theft, or the like, and an alarm is activated in any of these situations. The sensor can detect alterations to itself as well. For example, if sabotaged by covering or by spraying with IR-opaque material, then the sensor no longer receives any IR input (or receives substantially reduced IR input) from the target and has no signal output, in which case the processor can send a "sabotage" or an alarm signal. Each scanned sensor output temperature profile can be checked against a long term average profile or "signature" profile in order to detect rapid changes in profile.

Figure 5:
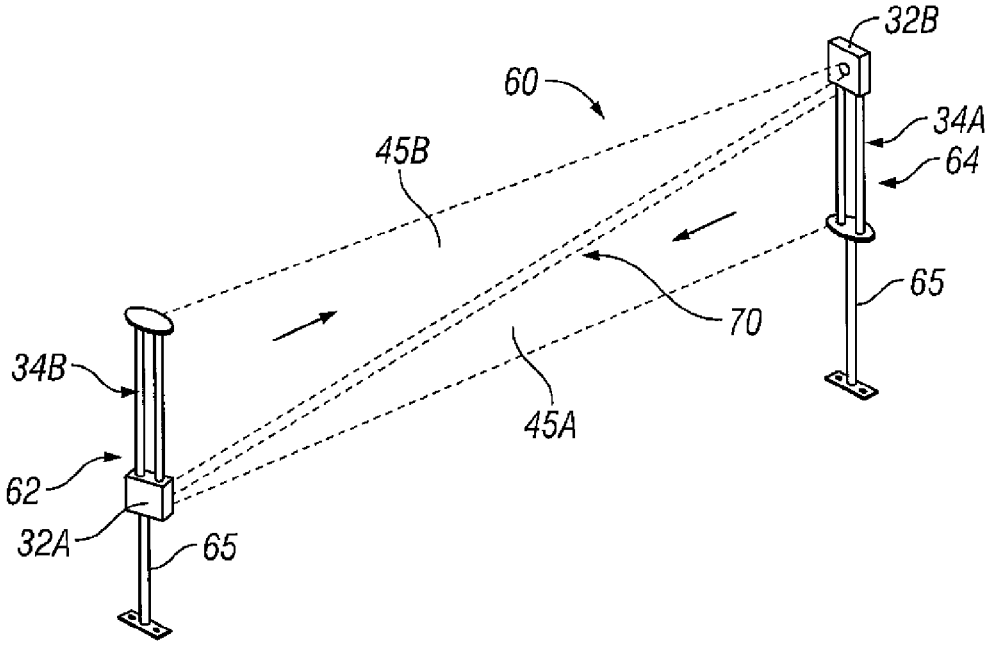
FIG. 5 is a perspective view of a second embodiment of a defined target IR motion sensor system.

In one embodiment, a fence-like perimeter-monitoring segment 60 is provided, as illustrated in FIG. 5. The sensor system of FIG. 5 comprises first and second, reciprocal sensor target pairs or units 62, 64, one at each of two endpoints, with one set facing in each direction, so as to realize a consistent "fence height". Each sensor/target pair is supported on a vertical support post 65 of the appropriate fence height. The first sensor/target set 62 has a sensor unit 32A at the lower end and a rectangular target 34B extending upward from the sensor unit. The second, reciprocal sensor/target set 64 has a target 34A extending upward from post 65 and a sensor unit 32B at the upper end. Sensor unit 32A is positioned to receive radiation from target 34A of sensor/target set 64 and monitor volume 45A, while sensor unit 32B is positioned to receive radiation from target 34B of sensor/target set 62 and monitor volume 45B. Similar sensor/target sets may be provided around an entire perimeter to be monitored, forming a virtual "fence" 70, with the height of the sensor/target pairs or units 62, 64 being equal to the desired fence height. One advantage of this embodiment is that it is relatively easy to determine when a signal change is due to a bird flying between the sensor and target. In the signal sensor system of FIG. 3, the target has a minimum size of the order of human size. However, a bird flying close to the sensor could still block the sensor entirely. In the reciprocal system of FIG. 5, a bird could potentially block one of the sensors entirely, if flying close to the sensor, but would not cause any signal change in the other direction. Thus, in this embodiment, human intrusion would be confirmed by changes in both output signal profiles, whereas a change in the signal emitted by one sensor/target pair and not the other pair could be further analyzed by signal size and be interpreted either as an intrusion or as a non-emergency due to blocking by a small bird or the like.

Another way of providing a constant "fence height" from the sensor endpoint to the target is to place multiple sensors at one endpoint to monitor a target at the other endpoint. The sensors are placed along a (typically vertical) line parallel to the target, and as long as the target. Thus, the "fence height" at the sensor end is provided by the several vertically-placed sensors, and at the target end by the monitored-volume height defined by the target.

Figure 6:
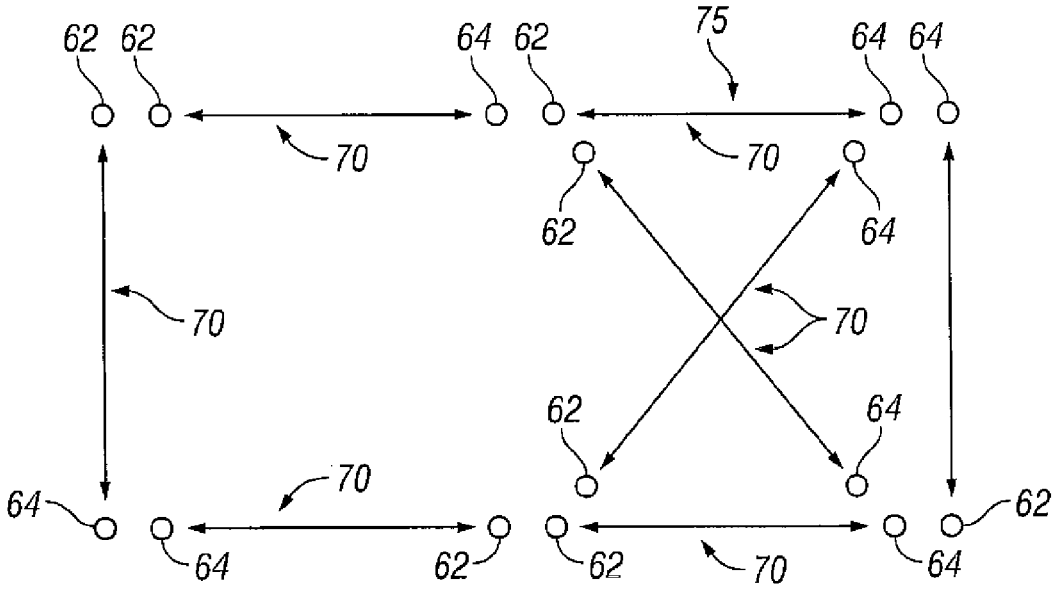
FIG. 6 is a schematic top plan view of another embodiment of a defined target IR motion sensor system with a plurality of the sensor/target pairs of FIG. 3 arranged in an array.

Unlike active-beam sensor prior art of FIG. 1, there are no pulsed IR light emitters in the system of FIGS. 3 to 5. This way, multiple systems (as installed for different perimeter sections) do not interact due to receivers receiving light from transmitters other than their intended mates (a condition called "crosstalk"). Thus, with crosstalk not present, relatively complex arrays of "fences" can be arranged. FIG. 6 illustrates one possible embodiment of a defined target IR motion sensor system 65 in which an array of reciprocal sensor-target pairs 62, 64 are positioned to form virtual "fences" 70 generally indicated by arrowed lines between each sensor target pair. The arrangement may include fences which are arranged to cross over, in a generally x-shaped formation, as indicated in the right hand side of FIG. 6, to detect movement within an enclosed area.

In the embodiment of FIG. 3, the sensor is a scanning sensor which detects varying IR emission over time, according to the size of the scanning monitored volume 54 and the intersection of the scanned volume with the target's non-uniform IR emission profile. In an alternative embodiment, the scanning sensor of FIG. 3 may be replaced with a continuous sensor having a static monitored volume (which may be the same as volume 54 of FIG. 3 or a volume corresponding to the monitored volume 45 of FIG. 3), and the defined target may instead have a non-uniform IR emission profile which varies with time. In this embodiment, no scanning is needed, as the target provides an oscillating IR radiation source which is placed remotely from the sensor, yet within the sensor's stationary monitored volume. The remote target unit's radiation causes the sensor to produce a signature signal corresponding to its time variation (for example, as an oscillation frequency). In this embodiment, processor 50 monitors the signal output for signature-signal content deviation from the simple steady signature signal corresponding to the target source's time variation. Such signal deviation indicates that an intervening object has blocked the sensor's view of the target by occupying the volume defined by the intersection of the target with the sensor's overall monitored volume.

Figure 7:
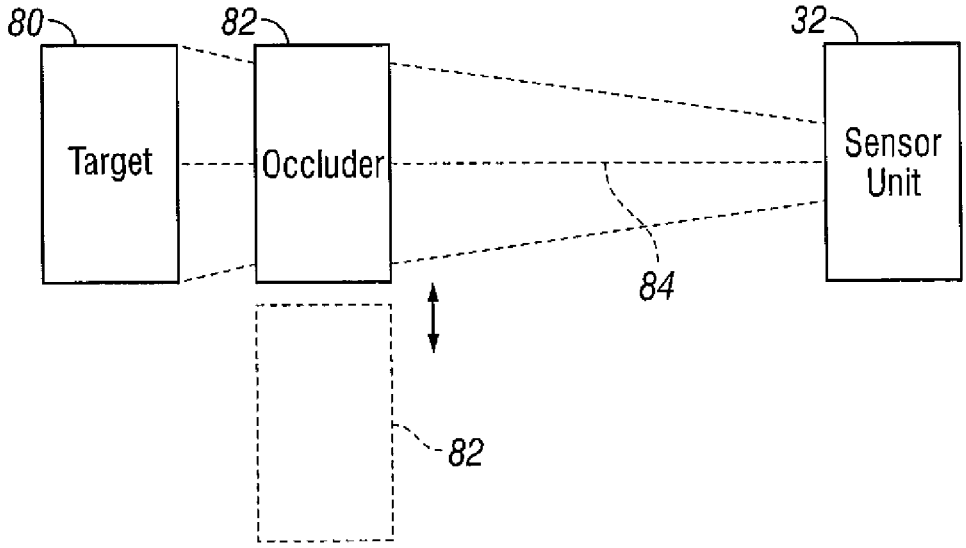
FIG. 7 is a schematic block diagram of an alternative target/sensor arrangement in which an occluder alternately blocks and unblocks the target IR emission to provide a temporally non-uniform emission.

As with the preceding embodiments, the target is larger than a point source or small-diameter beam, and may be human-sized or larger, providing a large monitored volume and controlled detection range based on the distance between the sensor and target. The non-uniform, oscillating radiation target may be similar to the target of FIG. 3 and may have one or more varying emitters such as one or more rods 36 which are controllably heated to have a predetermined pattern of oscillating temperatures over time. Alternatively, as illustrated schematically in FIG. 7, the target may be a rod 80 at a constant temperature whose IR emission is alternately blocked and unblocked, or "chopped", by an occluder 82 of a different temperature within the sensor-target axis 84, as illustrated schematically in FIG. 7. The occluder 82 is moved back and forth between the solid and dotted line positions of FIG. 7 by any suitable rotating or linear drive mechanism. In one embodiment, the IR emission is completely blocked when the occluder is in the solid line position, while in other embodiments it is partially blocked. In each case, a predetermine oscillating IR radiation emission is seen by the sensor unit and can be used by the controller as a signature sensor output temperature profile when looking for variations indicating objects in the emission path.

Figure 8:
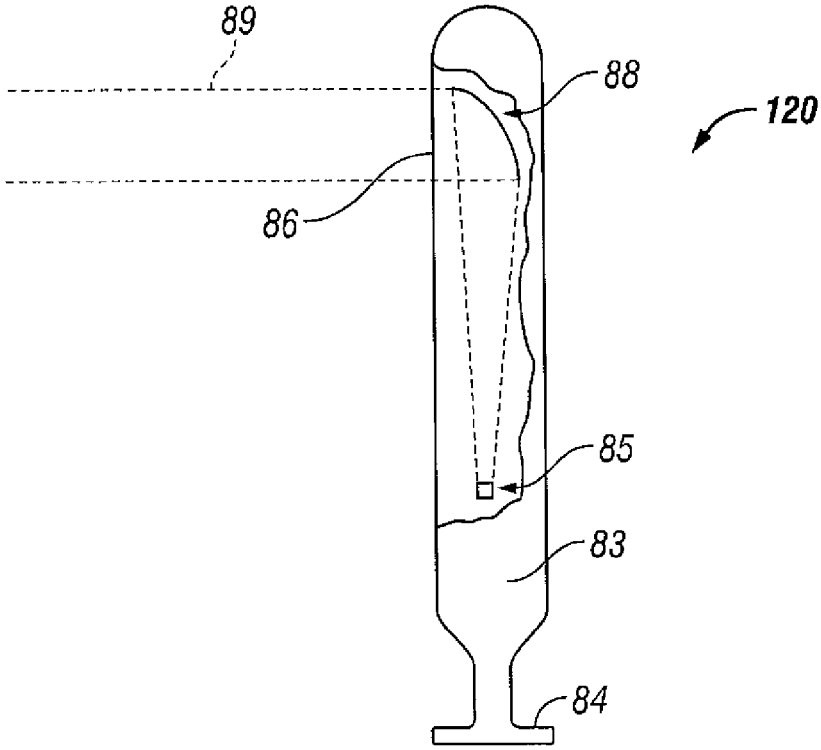
FIG. 8 is a side elevation view, partially broken away, of one embodiment of a PIR sensor with vertical optics for use in an IR motion sensor system.

Since a "beam" type sensor generally monitors a long, narrow volume, its optics and detector are designed accordingly. Detectors of finite size (i.e. not "point" detectors), when combined with focusing optics, produce fields-of-view having non-parallel edges that define a field-of-view angle. Because of the angle, the cross-sectional area of the field-of-view is continuously expanding with increasing distance from the sensor, and can become wider than that of the actual space to be monitored (such as a corridor or the volume above the perimeter strip around a building). For example, an application may require a 1-meter wide field-of-view at 200 m distance from the sensor, which requires a 0.3-degree field-of-view. Since the field-of-view angle depends on the ratio between detector size and optics focal length, and since detectors on the market are typically at least 1.0 mm wide, a 200 mm focal length is used to provide the desired field-of-view. Such narrow-beam PIR sensors are typically housed in a long-aspect-ratio cylinder or rectangular prism, and oriented with their long axis in the same direction as the long axis of the volume to be monitored, which is usually horizontal. However, at times, a long horizontally-oriented sensor unit containing the long-focal-length optics for monitoring narrow volumes may be undesirable. For example, around a residence, horizontally-oriented sensors may resemble high-security cameras, and thus create more of a "secured installation" look than might be desired by the residence inhabitants. FIG. 8 illustrates an embodiment of a PIR sensor 120 with vertically oriented optics, which may be used as the PIR sensor or one of the PIR sensors in any of the infrared motion sensor systems described above, or in known PIR sensor systems such as those of FIG. 1 or FIG. 2, where it is desirable that a sensor have a horizontal dimension smaller than its optics' required focal length for narrow fields-of-view.

The vertically oriented PIR sensor device 120 of FIG. 8 has a post shaped, generally cylindrical outer housing 83 with a base support 84 and a PIR sensor 85 supported inside the housing towards its lower end and facing upwards. An IR window or opening 86 is provided in the front of the housing, and an optical device such as a mirror 88 is positioned at an angle in the housing facing the opening, for re-directing the sensor's field-of-view 89 over some angle (for example, about 90 degrees, as illustrated in FIG. 8), to provide an interface between horizontal-axis monitored volumes and long-focal-length vertical-axis optics. Continuing to consider the residence example noted above, this allows design of a narrow-field-of-view PIR sensor, with no horizontally-oriented feature. The optical element 88 provides a vertical-to-horizontal (sensor-optics to monitored-volume) interface. One or more PIR sensor devices 120 may be used together with one or more spatially or temporally non-uniform targets in any of the motion sensor systems described above in connection with FIGS. 3 to 7. A number of vertical posts 120 may be arranged around a residence without producing a high-security installation "look" to the residence.

Figure 9A:
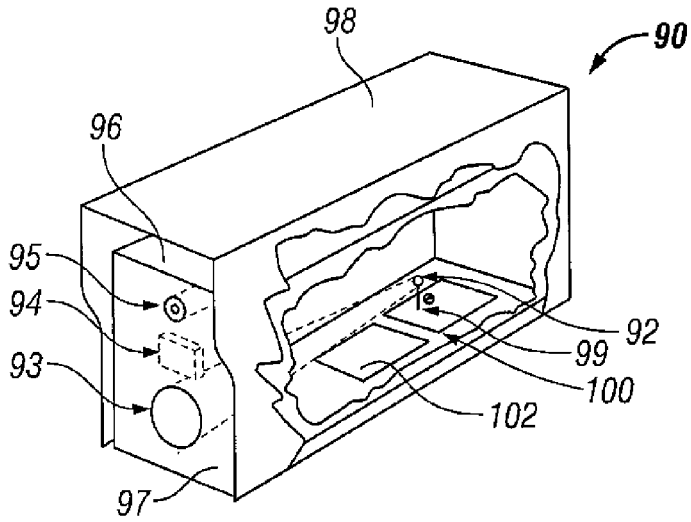
FIG. 9A is a perspective view, partially broken away, of one embodiment of a long range motion sensor unit combining a defined target PIR sensor with a microwave system and camera.
Figure 9B:
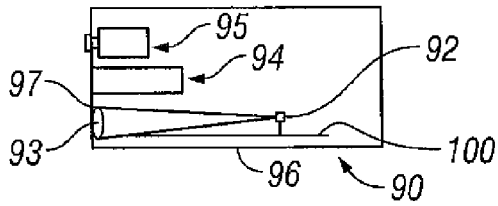
FIG. 9B is a cross-sectional view of the unit of FIG. 9A.

The PIR sensor unit of the sensor/target pairs described above in connection with the embodiments of FIGS. 3 to 8 may also be modified to include one or more additional types of sensors or intrusion detectors for providing more detailed confirmation of the type of moving object that has caused a PIR motion detection. FIGS. 9A and 9B illustrate one embodiment of a multiple sensor unit 90 which includes a PIR sensor 92 and associated optical element 93, a microwave unit 94 which may be a microwave antenna or Doppler unit, and a camera 95, all enclosed in a suitable outer housing 96 with a front wall 97 having window openings aligned with the camera and PIR sensor optics. A sun shield 98 may be mounted over the enclosure or housing 96 and extend forward from front wall 97, as illustrated in FIG. 9A, where the unit 90 is intended for outdoor use. The PIR sensor may be a scanning sensor with a scanning element 99, and suitable IR control electronics 100 and master electronics or controller circuitry 102 may be mounted inside housing 96.

Sometimes, even a very high-quality PIR sensor can indicate motion of a kind that is not needed for the application. For example, a PIR perimeter sensor might indicate motion because a bird flew through its monitored volume. In order to provide better detection of human rather than small animal or bird movements, the unit 90 of FIGS. 9A and 9B combines a defined-target PIR sensor with a microwave sensing unit and a camera, and may be used in place of any of the PIR-only sensor units of FIGS. 3 to 8. In alternative embodiments, the unit 90 may combine a PIR sensor with one additional sensing unit, for example only a microwave unit or only a camera. The microwave sensing unit may comprise a microwave Doppler transceiver, quadrature Doppler transceiver (for motion direction detection), Frequency Modulated Continuous Wave (FMCW) transceiver (for motion range detection), or ultra-wideband RADAR (also for motion range detection), or other types of microwave detector units. In order to improve the situation of the "flying bird" unnecessary motion indication, microwave motion range information can be interpreted by a processor, in combination with the microwave and PIR signal sizes, in order to determine whether the moving object that crossed the perimeter is too small to be a human intruder. If the detected moving object is detected to be non-human, no motion is indicated and no alarm is generated.

The camera may be a still or video camera at IR, NIR and visible wavelengths, and includes image processing software that can evaluate the characteristics of a moving object. Again returning to the task of eliminating the "flying bird" unnecessary motion indication, this can be done by the PIR sensor first detecting motion, followed by a process of camera images being weighed by firmware (for example as to object shape) in combination with the PIR signal characteristics. Alternately, the initial PIR motion indication can be sent, and the camera image further evaluated by a remote human operator to determine whether or not it is a false alarm. In either case, the result is that the bird is disqualified as indicator for any further action. In order to satisfy the most demanding applications, a defined-target PIR sensor is combined with both a microwave system and a camera, as illustrated in FIGS. 9A and 9B. In this case, the "flying bird" unnecessary motion indication can be even more easily prevented, as the microwave range information, PIR signal characteristics and camera image size can all be combined to yield definitive information about the size and other characteristics of the moving object.

Figure 10:
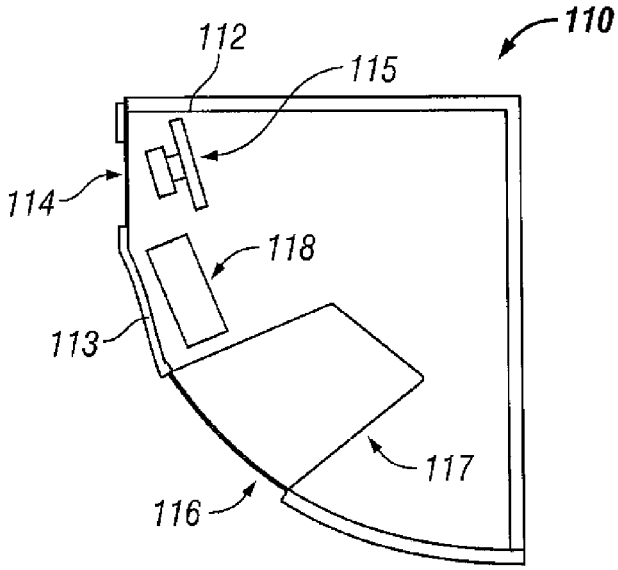
FIG. 10 is a horizontal cross-sectional view of a modified long range motion sensor unit combining a scanning PIR sensor with a microwave system and camera.

FIG. 10 illustrates a combined PIR sensor, microwave sensor and camera unit 110 which is more suitable for indoor use. The unit has an outer housing or enclosure 112 with an arcuate front wall 113 having a camera window 114 aligned with a mini PCB (printed circuit board) camera 115 inside the housing, and an IR window 116 aligned with an IR scanning unit 117 including a PIR sensor inside the housing. A microwave Doppler unit 118 may also be mounted inside the housing. Each sensor unit is suitably linked to a controller for monitoring and processing the various sensor outputs to identify intrusion by a moving object as well as size and other characteristics of the object, so as to exclude non-human intrusions.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. An infrared motion sensor system, comprising:

a sensor unit comprising at least a first infrared (IR) motion sensor having a predetermined field of view;

at least a first target located at a predetermined distance from the first IR motion sensor within the field of view of the first IR motion sensor, the first target emitting a non-uniform pattern of IR radiation in a first direction; and a processor which monitors a sensor output signal over time to determine periodic current sensor output temperature profiles, compares each current sensor output temperature profile to a signature output temperature profile corresponding to the non-uniform pattern of IR radiation emitted by the first target, and provides an alarm output on detection of variations between the current sensor output temperature profile and the signature output temperature profile.

2. The system of claim 1, wherein the first target emits a constant, spatially non-uniform pattern of IR radiation.

3. The system of claim 2, wherein the first target has areas of different materials having different IR emissivity.

4. The system of claim 1, wherein the first target has a temporally non-uniform IR emission pattern.

5. The system of claim 4, wherein the first target has a temperature which oscillates over time.

6. The system of claim 4, wherein the first target comprises a constant temperature target member, a target-occluding member between the target member and sensor, and a drive device which reciprocates one of the members relative to the other member whereby the IR emission of the target member is alternately blocked and un-blocked by the target-occluding member to produce a temporally non-uniform IR emission.

7. The system of claim 1, further comprising a scanning drive device which scans the field of view of the first IR motion sensor repeatedly across a monitored volume larger than the field of view, the first target being located within the total monitored volume.

8. The system of claim 7, wherein the field of view has a transverse cross-sectional area at the predetermined distance from the target which is at least equal in size to the approximate size of an average human adult.

9. The system of claim 1, wherein the size of the first target is at least equal to the approximate size of an average human adult.

10. The system of claim 1, wherein the first target comprises at least two spaced, vertically oriented rods of different materials having different IR emissivities.

11. The system of claim 1, wherein the first target has a rectangular shape and defines a pyramid-shaped monitored volume between the sensor and target.

12. The system of claim 1, further comprising a plurality of sensor/target pairs each comprising a sensor and a target at a predetermined distance from the sensor, the sensor/target pairs being positioned to form a virtual fence around a monitored area.

13. The system of claim 1, comprising first and second spaced, reciprocal sensor/target units, the first sensor/target unit comprising the first IR motion sensor and a second target vertically spaced above the first IR motion sensor, the second target emitting a non-uniform IR radiation pattern in a second direction opposite to the first direction, and the second sensor/target unit comprising the first target and a second IR sensor vertically spaced above the first target and having a field of view including the second target, the first IR motion sensor facing in the second direction to receive IR radiation emitted in the first direction by the first target, the second IR sensor facing in the first direction to receive IR radiation emitted in the second direction by the second target.

14. The system of claim 13, wherein the first and second reciprocal sensor/target units comprise one segment of a virtual fence.

15. The system of claim 14, comprising a plurality of reciprocal sensor/target units arranged in a predetermined pattern to form fence segments to monitor a predetermined area.

16. The system of claim 15, wherein the reciprocal sensor/target units are positioned end to end to form a rectangular fence.

17. The system of claim 15, wherein at least two sensor/target units are positioned to form segments which cross over one another to form an X-shape.

18. The system of claim 1, wherein the target extends in a generally vertical direction, and a plurality of vertically spaced sensors are positioned to face the target, the vertically spaced sensors defining a line of sensors having a length substantially equal to the vertical length of the target.

19. The system of claim 1, wherein the sensor unit has a vertically oriented outer housing having a lower end and an upper end, an IR transmitting window adjacent the upper end of the housing facing the target, an upwardly facing IR sensor element mounted inside the housing at a location closer to the lower end of the housing than the upper end of the housing, and an optical element inside the housing facing the window and the sensor element and configured to direct IR radiation from the target onto the sensor element.

20. The system of claim 19, wherein the outer housing comprises a vertically oriented cylinder of generally post-like shape.

21. The system of claim 1, wherein the sensor unit further comprises at least one additional, different type of sensor.

22. The system of claim 21, wherein the additional sensor comprises a camera.

23. The system of claim 21, wherein the additional sensor comprises a microwave sensing device.

24. The system of claim 23, wherein the microwave sensing device is selected from the group consisting of microwave Doppler transceivers, frequency modulated continuous wave (FMCW) transceivers, and ultra-wideband radar.

25. The system of claim 21, wherein the sensor unit has two additional sensors comprising a microwave sensing device and a camera.

26. The system of claim 21, wherein the sensor unit has an outer housing and the sensors and processor are mounted inside the housing.

27. The system of claim 21, wherein the processor monitors the outputs of both sensors.

28. The system of claim 1, wherein the IR motion sensor is a passive infrared (PIR) motion sensor.

29. The system of claim 1, wherein the processor is configured to produce a sensor sabotage signal output indicating blocking of the sensor on detection of a substantial reduction or elimination of the IR radiation input received by the IR motion sensor.

30. The system of claim 1, wherein at least part of the target comprises at least one protected object, whereby removal of the protected object produces a change in the non-uniform pattern of radiation emitted by the first target, and an alarm output indicates removal of the protected object or movement of an individual between the target and sensor unit.

31. A method of detecting intrusion in a monitored area, comprising:

receiving output of an infrared (IR) sensor having a monitored volume which includes a target at a predetermined distance from the IR sensor, the target having a spatially or temporally non-uniform IR emission pattern;

processing the output of the IR sensor to create a signature temperature profile of the non-uniform IR emitting target;

monitoring the output of the IR sensor over time and comparing each monitored output signal profile to the signature temperature profile to detect any variations from the signature temperature profile due to interruption of the target IR emission pattern before reaching the IR sensor or due to changes in the target;

providing an alarm output if the monitored output signal profile varies from the signature temperature profile.

32. The method of claim 31, further comprising scanning the IR sensor repeatedly over the monitored volume, the IR sensor having a stationary field of view smaller than the monitored volume.

33. The method of claim 31, further comprising oscillating the IR emission output of the target over time, whereby the IR emission pattern of the target is temporally non-uniform and the signature temperature profile includes the standard oscillation of the target signature emission pattern over time, and the step of detecting variations between a current sensor output signal and the signature temperature profile comprises detecting variations from the oscillating signature emission pattern.

34. The method of claim 31, further comprising placing a plurality of IR sensor and target pairs around the perimeter of an area to be monitored to form a virtual fence, and monitoring the outputs of all of the IR sensors to detect any intrusion into the area.

35. The method of claim 31, further comprising positioning first and second sensor/target units at a predetermined spacing, each sensor/target unit comprising a sensor and a target, the first sensor/target unit having a first target and a second sensor spaced vertically above the first target and facing in a first direction, and the second sensor/target unit having a second target positioned in the monitored volume of the second sensor and a first sensor spaced vertically above the second target, the first target being positioned in the monitored volume of the first sensor, and the second sensor/target unit facing in a second direction opposite to the first direction, processing the output signal of the first sensor to create a first signature temperature profile of the non-uniform IR emitting first target, processing the output signal of the second sensor to create a second signature temperature profile of the non-uniform IR emitting second target, monitoring the outputs of the first and second IR sensors over time and comparing each monitored output signal profile to the first and second signature temperature profile, respectively, to detect any variations from first and second signature temperature profile indicating interruption of the target IR emission pattern before reaching the sensor.

36. The method of claim 35, further comprising providing an alarm output if the monitored output signals of both the first and second sensors vary from the corresponding first and second signature temperature profiles, respectively, and providing no alarm output if only one monitored output signal varies from the corresponding signature temperature profile.

37. The method of claim 35, further comprising positioning a plurality of first and second sensor/target units to form successive segments of a virtual fence surrounding an area to be monitored.

38. The method of claim 37, further comprising positioning first and second sensor/target units at opposite ends of a first line extending across the area and positioning additional first and second sensor/target pairs at opposite ends of a second line which crosses over the first line to form an X-shape.

39. The method of claim 31, further comprising providing a sensor sabotage signal output indicating blocking of the sensor on detection of a substantial reduction or elimination of the IR radiation input received by the IR motion sensor.

40. The method of claim 31, further comprising providing at least one protected object as at least part of the target, whereby removal of the protected object produces a change in the non-uniform pattern of radiation emitted by the target, and an alarm output indicates removal of the protected object or movement of an individual between the target and sensor unit.

* * * * *